United States Patent [19]

Hamada et al.

[11] Patent Number: 4,519,642

[45] Date of Patent: May 28, 1985

[54] LOCKING DEVICE

[75] Inventors: Eiichi Hamada; Kouzou Hamada, both of Toyota, Japan

[73] Assignee: Toyota Jidosha Kabushiki Kaisha, Aichi, Japan

[21] Appl. No.: 523,710

[22] Filed: Aug. 16, 1983

[30] Foreign Application Priority Data

Oct. 12, 1982 [JP] Japan ..... 57-154258[U]

[51] Int. Cl.[3] ..... E05C 5/04

[52] U.S. Cl. ..... 292/247; 292/DIG. 49

[58] Field of Search ..... 292/113, 247, 246, 300, 292/304, DIG. 22, DIG. 65

[56] References Cited

U.S. PATENT DOCUMENTS

| | | | |
|---|---|---|---|
| 3,030,137 | 4/1962 | Cheney | 292/247 X |
| 3,828,885 | 8/1974 | Eissinger et al. | 292/DIG. 65 X |
| 4,382,570 | 5/1983 | Craig | 292/247 X |

*Primary Examiner*—Richard E. Moore

*Attorney, Agent, or Firm*—Parkhurst & Oliff

[57] ABSTRACT

A locking device comprising a handle rotatably supported on a body through a support shaft, a catch hook rotatably supported by said handle through a rotary shaft, and a hook secured to a counterpart member to be fastened to or detached from said body and engageable with said catch hook at the time of locking, said rotary shaft for rotatably supporting the catch hook on the handle being provided at a position closer to the body than a straight line passing through the support shaft and a portion of engagement between the catch hook and the hook when the handle approaches the body to take a locking position, and the counterpart member being locked against the body through the catch hook through a turnover action of the catch hook, said action occurring when the handle rotates, wherein there is provided a retainer to be projected to a position close to an opposite side portion of the handle during locking, said opposite side portion being substantially opposite to the rotary shaft with the support shaft interposed therebetween and including the support shaft, and to be disposed at a position where the retainer abuts against the opposite side portion when the hook together with the counterpart member move relative to the handle in a direction of the handle.

16 Claims, 2 Drawing Figures

LOCKING DEVICE

BACKGROUND OF THE INVENTION

1. Field of the Invention

This invention relates to locking devices, and more particularly to improvements in locking devices for detachably locking an engine cover or a seat of a motor car such for example as a cab-over type motor car by means of a turnover mechanism.

2. Description of the Prior Art

As shown in FIG. 1 for example, heretofore a front seat 1 in a cab-over type motor car, not shown generally, has been usually installed on an engine service cover 2. A seat rail, not shown, for this front seat 1 and an anchor 4 of a seatbelt 3 for restraining an occupant is secured to this engine service cover 2. The aforesaid engine service cover 2 is rotatably secured at the rear end thereof to a floor 6 through a hinge 5 so as to be openable upwardly when an engine, not shown, disposed downwardly thereof is subjected to an inspection or the like, and detachably secured at the forward end thereof to the floor 6 through locking devices 7.

The aforesaid locking devices 7 each comprises: a handle 9 rotatably supported on the floor 6 through a support shaft 8; a catch hook 11 rotatably supported by this handle 9 through a rotary shaft 10; and a hook 12 secured to the engine service cover 2 to be fastened to or detached from the floor 6 and engageable with the catch hook 11 at the time of locking. A rotary shaft 10 for rotatably supporting the catch hook 11 on the handle 9 is provided at a position closer to the floor 6 than a straight line passing through the support shaft 8 and a portion of engagement between the catch hook 11 and the hook 12 when the handle 9 approaches the floor 6 to take a locking position, so that the engine service cover 2 can be locked against the floor 6 through the catch hook 11 through a turnover action of the catch hook 11, the action occurring when the handle 9 rotates.

The above-described locking devices 7 of the prior art are disadvantageous in that, when there occurs a relative displacement, which causes the hook 12 to move forward, between the hook 12 and the handle 9 due to an external force such for example as an inertial force, a clamping force by the catch hook 11 is weakened, whereby the handle 9 floats up to a position close to the limit of turnover, so that the engine service cover 2 and the front seat 1 secured thereto float up, thus resulting in an unstable condition.

SUMMARY OF THE INVENTION

It is therefore the primary object of the present invention to provide a locking device for controlling a displacement of a hook relative to a handle in an unlocking direction in a simplified construction.

It is another object of the present invention to provide a locking device in which the handle is pushed in a locking direction to prevent unlocking when the hook is moved in the unlocking direction relative to the handle.

To this end, the present invention contemplates that, in a locking device comprising a handle rotatably supported on a body through a support shaft, a catch hook rotatably supported by the handle through a rotary shaft, and a hook secured to a counterpart member to be fastened to or detached from the body and engageable with the catch hook at the time of locking, the rotary shaft for rotatably supporting the catch hook on the handle being provided at a position closer to the body than a straight line passing through the support shaft and a portion of engagement between the catch hook and the hook when the handle approaches the body to take a locking position, and the counterpart member being locked against the body through the catch hook through a turnover action of the catch hook, the action occurring when the handle rotates, a retainer is secured to the hook to be projected to a position close to an opposite side portion of the handle during locking, the opposite side portion being substantially opposite to the rotary shaft with the support shaft interposed therebetween and including the support shaft, and to be disposed at a position where the retainer abuts against the opposite side portion when the hook together with the counterpart member move relative to the handle in a direction of the handle.

To the above end, the present invention contemplates that the retainer is disposed at a position where the forward end of the retainer abuts against said opposite side portion of the handle from behind, when the retainer together with the counterpart member move in the direction of the handle.

To the above end, the present invention contemplates that there is formed a gap at least so large as to allow the handle to rotate in the unlocking direction between the forward end of the retainer and the aforesaid opposite side portion of the handle.

To the above end, the present invention contemplates that the forward end portion of the retainer is curvingly extended along the surface of the body.

To the above end, the present invention contemplates that the retainer is secured to the hook at the side facing to the surface of the body.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENT

Detailed description will hereunder be given of an embodiment of the present invention with reference to the drawings.

Figure 1:
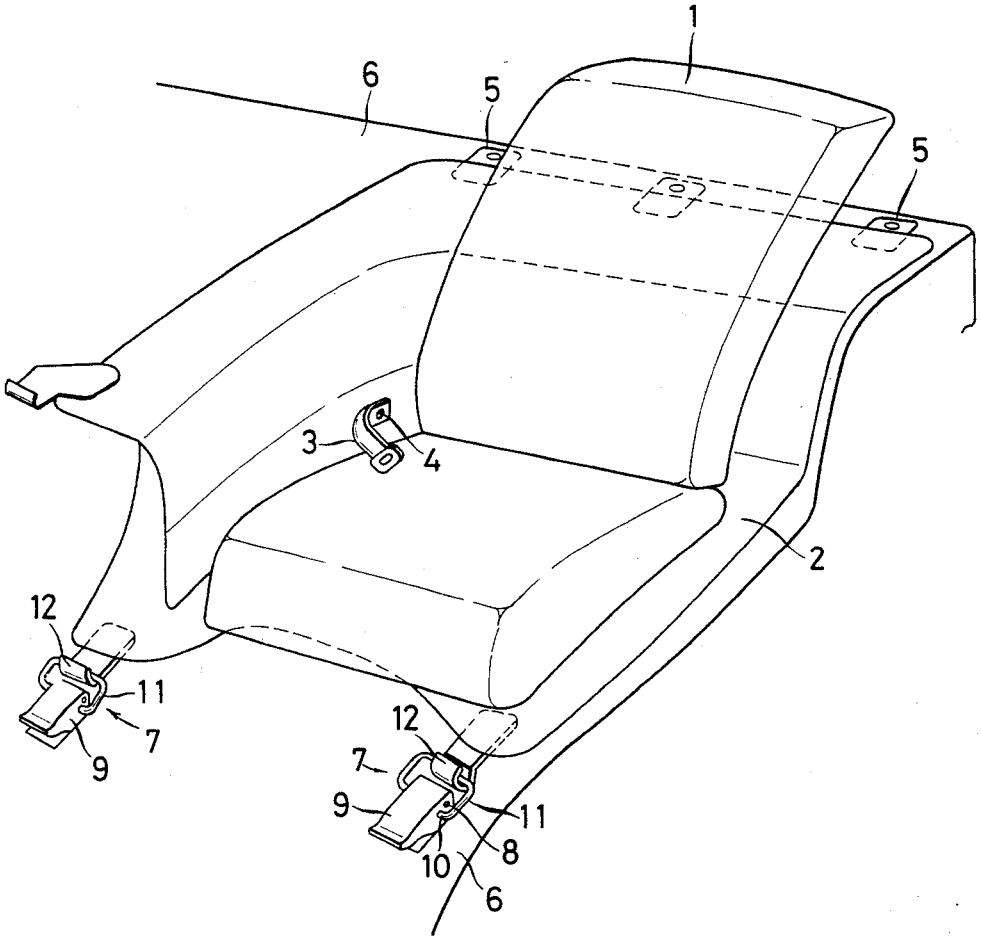
FIG. 1 PRIOR ART
FIG. 1 is a perspective view showing the locking device in the engine service cover of the prior art.
Figure 2:
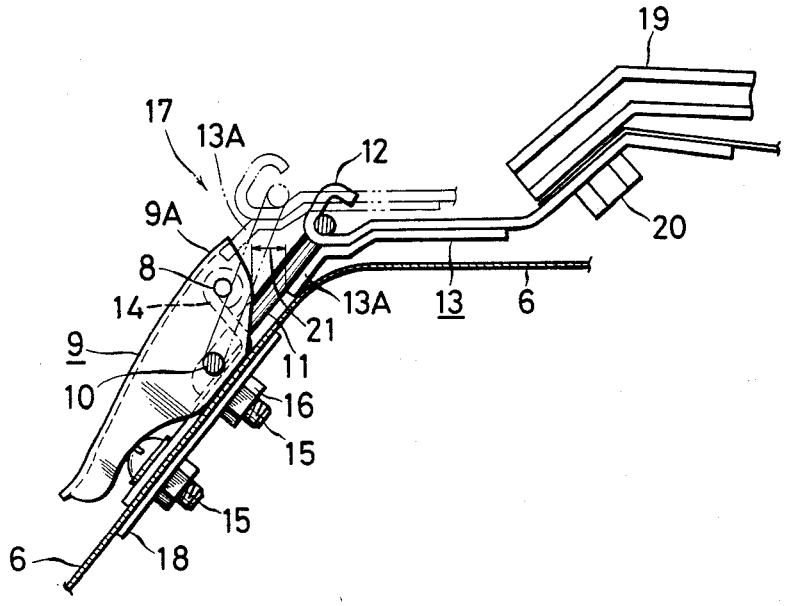
FIG. 2 is a cross-sectional view showing an embodiment of the locking device according to the present invention.

As shown in FIG. 2, according to this embodiment, in a locking device 17 comprising a handle 9 rotatably supported on a floor 6 through a support shaft 8, a catch hook 11 rotatably supported by the handle 9 through a rotary shaft 10, and a hook 12 secured to an engine service cover 2 to be fastened to or detached from the floor 6 and engageable with a catch hook 11 at the time of locking, the rotary shaft 10 for rotatably supporting the catch hook 11 on the handle 9 being provided at a position closer to the floor 6 than a straight line passing through the support shaft 8 and a portion of engagement between the catch hook 11 and the hook 12 when the handle 9 approaches the floor 6 to take a locking position, and the engine service cover 2 being locked against the floor 6 through the catch hook 11 through a turnover action of the catch hook 11 occurring when the handle rotates, there is provided a retainer 13 is secured on the hook 12 to a position close to an opposite side portion 9A of the handle 9 during locking, the opposite side portion 9A being substantially opposite to the rotary shaft 10 with the support shaft 8 interposed therebetween, and to be disposed at a position where the retainer abuts against the aforesaid opposite side portion 9A when the hook 12 together with the engine service cover 2 move in the direction of the handle 9. The retainer 13 is secured to the undersurface, i.e., the surface at the side of the floor 6 of the hook 12, and the forward end portion 13A thereof is curvingly extended along the floor 6. A gap 21 formed between the forward end portion 13A of the retainer 13 and the opposite side portion 9A of the handle 9 or the support shaft 8 is so large as to allow the handle 9 to rotate in the unlocking direction.

In FIG. 2, designated at reference numeral 14 is a catch base fastened around the support shaft 8 and secured to the floor 6 through a bolt 15, 16 a nut welded to a reinforcement 18 and threadably coupled to the bolt 15 at the undersurface of the floor 6, and 19 a seat rail together with the hook 12 being threadably coupled to the engine service cover 2 through a bolt 20.

In this embodiment, the retainer 13 is curvingly extended along the floor 6 in the normal state, so that the retainer 13 can be on standby, not hindering the locking or unlocking operation of the handle 9.

When the engine service cover 2 together with the hook 12 are displaced relative to the handle 9 due to an inertial force during deceleration of the motor car for example, the catch hook 11 engaging the hook 12 tends to rotate about the hook 12 in the counterclockwise direction in FIG. 2.

If this catch hook 11 rotates in the counterclockwise direction beyond a predetermined value, then the handle 9 reaches a position close to the limit of the turnover, whereby a force clamping the hook 12 by the handle 9 is weakened, so that the engine service cover 2 and the front seat 1 mounted thereon are brought into floating-up state.

In this embodiment, however, when the engine service cover 2 together with the hook 12 are displaced relative to the handle 9 and approach the handle 9, the forward end portion 13A of the retainer 13, which is integral with the hook 12, comes into contact with the opposite side portion 9A of the handle 9 as indicated by two-dot chain lines in FIG. 2.

In consequence, the forward end of the retainer 13 comes into abutting contact with the opposite side portion 9A, whereby the engine service cover 2, hook 12 and retainer 13 are precluded in any further relative displacement in the forward direction.

The retainer 13 is brought into abutting contact with the opposite side portion 9A of the handle 9 to be precluded in the further relative displacement in the forward direction, whereby a reaction force is generated. Since the handle 9 is pushed by the reaction force to rotate about the support shaft 8 in the counterclockwise direction in the drawing, i.e., in the locking direction, so that the handle 9 can be prevented from floating up in the unlocking direction.

Accordingly, in this embodiment, the engine service cover 2 and front seat 1 are precluded from floating up and the catch hook 11 is automatically prevented from unlocking.

The above embodiment is of such an arrangement that the forward end portion 13A of the retainer 13 comes into abutting contact with the opposite side portion 9A of the handle 9 when the engine service cover 2 makes a relative forward displacement, so that a displacement beyond a predetermined value can be prevented. This arrangement, however, is not exclusive and may be replaced by an arrangement in which the retainer 13 abuts against the handle or thereabout when the hook 12 is displaced relative to the handle 9 in the direction of the handle 9, so that a relative displacement beyond a predetermined value can be prevented.

Consequently, for example, the forward end of the retainer 13 may be brought into abutting contact with the support shaft 8 of the handle 9.

In order to control the relative forward displacement of the engine service cover 2, it is preferable to provide the forward end of the retainer 13 at a position as close to the opposite side portion 9A of the handle 9 or the support shaft 8 as possible during locking. However, in consideration of the case of opening the engine service cover 2, the gap 21 formed between the forward end portion 13A of the retainer 13 and the opposite side portion 9A of the handle 9 or the support shaft 8 must be at least so large as to allow the handle 9 to rotate in the unlocking direction.

The above embodiment teaches the locking device for fastening the engine service cover 2 to the floor 6 or detaching the same therefrom. However, the arrangement is not exclusive, and the invention may be normally applied to any arrangement in which the counterpart member is fastened to or detached from the body such as the floor by means of the turnover mechanism.

What is claimed is:

1. A locking device comprising a handle rotatably supported on a body through a support shaft, a catch hook rotatably supported by said handle through a rotary shaft, and a hook secured to a counterpart member to be fastened to or detached from said body and engageable with said catch hook at the time of locking, said rotary shaft for rotatably supporting the catch hook on the handle being provided at a position closer to the body than a straight line passing through the support shaft and a portion of engagement between the catch hook and the hook when the handle approaches the body to take a locking position, and the counterpart member being locked against the body through the catch hook through a turnover action of the catch hook, said action occurring when the handle rotates, wherein a retainer is secured to the hook to be projected to a position close to an opposite side portion of the handle during locking, said opposite side portion being substantially opposite to the rotary shaft with the support shaft interposed therebetween and including the support shaft, and to be disposed at a position where the retainer abuts against the opposite side portion when the hook together with the counterpart member move relative to the handle in a direction of the handle.

2. A locking device as set forth in claim 1, wherein said retainer is disposed at a position where the forward end of said retainer abuts against said opposite side portion of the handle from behind when said retainer together with said counterpart member move in the direction of the handle.

3. A locking device as set forth in claim 1, wherein there is formed a gap at least so large as to allow said handle to rotate in the unlocking direction between the forward end of said retainer and the opposite side portion of said handle.

4. A locking device as set forth in claim 2, wherein there is formed a gap at least so large as to allow said handle to rotate in the unlocking direction between the forward end of said retainer and the opposite side portion of said handle.

5. A locking device as set forth in claim 1, wherein the forward end portion of said retainer is curvingly extended along the surface of the body.

6. A locking device as set forth in claim 2, wherein the forward end portion of said retainer is curvingly extended along the surface of the body.

7. A locking device as set forth in claim 3, wherein the forward end portion of said retainer is curvingly extended along the surface of the body.

8. A locking device as set forth in claim 4, wherein the forward end portion of said retainer is curvingly extended along the surface of the body.

9. A locking device as set forth in claim 1, wherein said retainer is secured to said hook at the side facing to the surface of the body.

10. A locking device as set forth in claim 2, wherein said retainer is secured to said hook at the side facing to the surface of the body.

11. A locking device as set forth in claim 3, wherein said retainer is secured to said hook at the side facing to the surface of the body.

12. A locking device as set forth in claim 4, wherein said retainer is secured to said hook at the side facing to the surface of the body.

13. A locking device as set forth in claim 5, wherein said retainer is secured to said hook at the side facing to the surface of the body.

14. A locking device as set forth in claim 6, wherein said retainer is secured to said hook at the side facing to the surface of the body.

15. A locking device as set forth in claim 7, wherein said retainer is secured to said hook at the side facing to the surface of the body.

16. A locking device as set forth in claim 8, wherein said retainer is secured to said hook at the side facing to the surface of the body.

* * * * *